US010859356B1

(12) United States Patent
Dindl

(10) Patent No.: US 10,859,356 B1
(45) Date of Patent: Dec. 8, 2020

(54) CARTRIDGE FOR COOLING GUN BARRELS

(71) Applicant: U.S. Government as Represented by the Secretary of the Army, Dover, NJ (US)

(72) Inventor: Frank J. Dindl, Newton, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/784,789

(22) Filed: Feb. 7, 2020

(51) Int. Cl.

| | |
|---|---|
| ***F42B 14/04*** | (2006.01) |
| ***F42B 5/145*** | (2006.01) |
| ***F42B 5/24*** | (2006.01) |
| ***F41A 9/50*** | (2006.01) |
| *F41A 9/29* | (2006.01) |

(52) U.S. Cl.
CPC ..... *F42B 14/04* (2013.01); *F41A 9/50* (2013.01); *F42B 5/145* (2013.01); *F42B 5/24* (2013.01); *F41A 9/29* (2013.01)

(58) Field of Classification Search
CPC ..... F42B 5/24; F42B 5/145; F42B 14/04
See application file for complete search history.

(56) References Cited

U.S. PATENT DOCUMENTS

| | | | | | |
|---|---|---|---|---|---|
| 440,672 | A * | 11/1890 | Wesson | F42B 14/04 | 102/511 |
| 499,487 | A * | 6/1893 | Wesson | F42B 14/04 | 102/511 |
| 2,740,356 | A * | 4/1956 | Millns | F42B 5/24 | 102/531 |
| 5,233,128 | A * | 8/1993 | Lai | F42B 5/24 | 102/511 |
| 5,834,673 | A * | 11/1998 | Gustavsson | F42B 5/24 | 86/1.1 |
| 9,052,175 | B1 * | 6/2015 | Calvert | F42B 5/145 | |
| 2018/0283833 | A1 * | 10/2018 | Mackenzie | F41A 29/02 | |

FOREIGN PATENT DOCUMENTS

| | | | | |
|---|---|---|---|---|
| DE | 29707924 U1 * | 7/1997 | ..... | F42B 5/145 |

* cited by examiner

*Primary Examiner* — Gabriel J. Klein
(74) *Attorney, Agent, or Firm* — Michael C. Sachs

(57) ABSTRACT

A liquid or powder filled cartridge is used to cool and lubricate the bore of gun barrels to eliminate cook off and improve barrel life. A primer is used to rupture the nose of the cartridge and propel the cooling material into the bore. The coolant absorbs heat from the bore of the barrel and is ejected from the muzzle of the weapon. The liquid or powder may include lubricants, preservatives, antifreeze, coolants, cleaners, or mixtures thereof, or other materials to enhance barrel performance. The liquid or powder filled cartridge is particularly well suited to externally powered weapons. Ammunition may be fed into the weapon using a mix of conventional cartridges and coolant filled cartridges. Internally cooling the barrel may be used to reduce or eliminate cook off and increase barrel life.

4 Claims, 6 Drawing Sheets

CARTRIDGE FOR COOLING GUN BARRELS

U.S. GOVERNMENT INTEREST

The inventions described herein may be made, used, or licensed by or for the U.S. Government for U.S. Government purposes.

BACKGROUND AND BRIEF SUMMARY OF INVENTION

Conventional firearms, and rapid firing machine guns, automatic cannons, and similar weapons are designed to resist cook off and to provide long barrel life. Conventional weapons use relatively heavy barrels, often made using exotic materials to maximize barrel life and resistance to cook off. Previous attempts to actively cool the barrel have not been able to effectively eliminate cook off.

The present invention for cooling objectives provides a cartridge which is additionally fluid or powder filled. The fluid or powder is a coolant, lubricant, preservative, antifreeze, cleaners, or mixtures thereof, or other materials, designed to enhance barrel performance. In one embodiment the primer is separated from a cavity containing the fluid or powder by a sealed barrier. The primer ruptures this barrier during firing. In another embodiment the ogive of the cartridge has pre-scored sections or similar features designed to rupture when the primer pressurizes the cartridge. Upon primer ignition, hot gases are released which in turn cause weak points in the tip or ogive of the cartridge case to split. This in turn propels the fluid or powder into the bore of the weapon barrel. The cartridge of this invention is particularly well suited to externally powered rapid fire weapons. The present invention is applicable to cartridge cases made of brass, steel, aluminum, polymer, hybrids of same, and other case materials.

In a further embodiment, the cartridge may contains a magnet, magnetic material, or other means that allows the weapon controller to sense when a fluid or powder filled cartridge is about to be fed into the weapon.

In another embodiment, the weapon controller may be designed to anticipate when liquid or powder filled cartridges are going to be chambered. A weapon controller may be designed to then extend firing bursts such that a conventional cartridge is always the first round fired at the beginning of each trigger pull sequence.

OBJECTS OF THE INVENTION

Accordingly, it is an object of the present invention to provide means for cooling a gun barrel by periodically firing coolant cartridges among the ordinary ammunition being fired.

Another object of the present invention is to provide a coolant cartridge of ammunition which releases fluidic and powder compositions into the gun barrel as it is fired.

It is a further object of the present invention to provide a coolant cartridge of ammunition which releases coolants, lubricants, preservatives, antifreeze, cleaners, or mixtures thereof into the gun barrel when fired.

It is yet another object of the present invention to provide a coolant ammunition round carrying fluids of liquefied magnetic materials or fluids which contain magnetic bits therein, to facilitate rapid detection of a coolant round by its magnetic properties.

It is a still further object of the present invention to provide a weapon controller system which may adjust the burst firing of ammunition to accommodate coolant rounds in the burst.

These and other objects, features and advantages of the invention will become more apparent in view of the within detailed descriptions of the invention, the claims, and in light of the following drawings and/or tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

Figure 6:
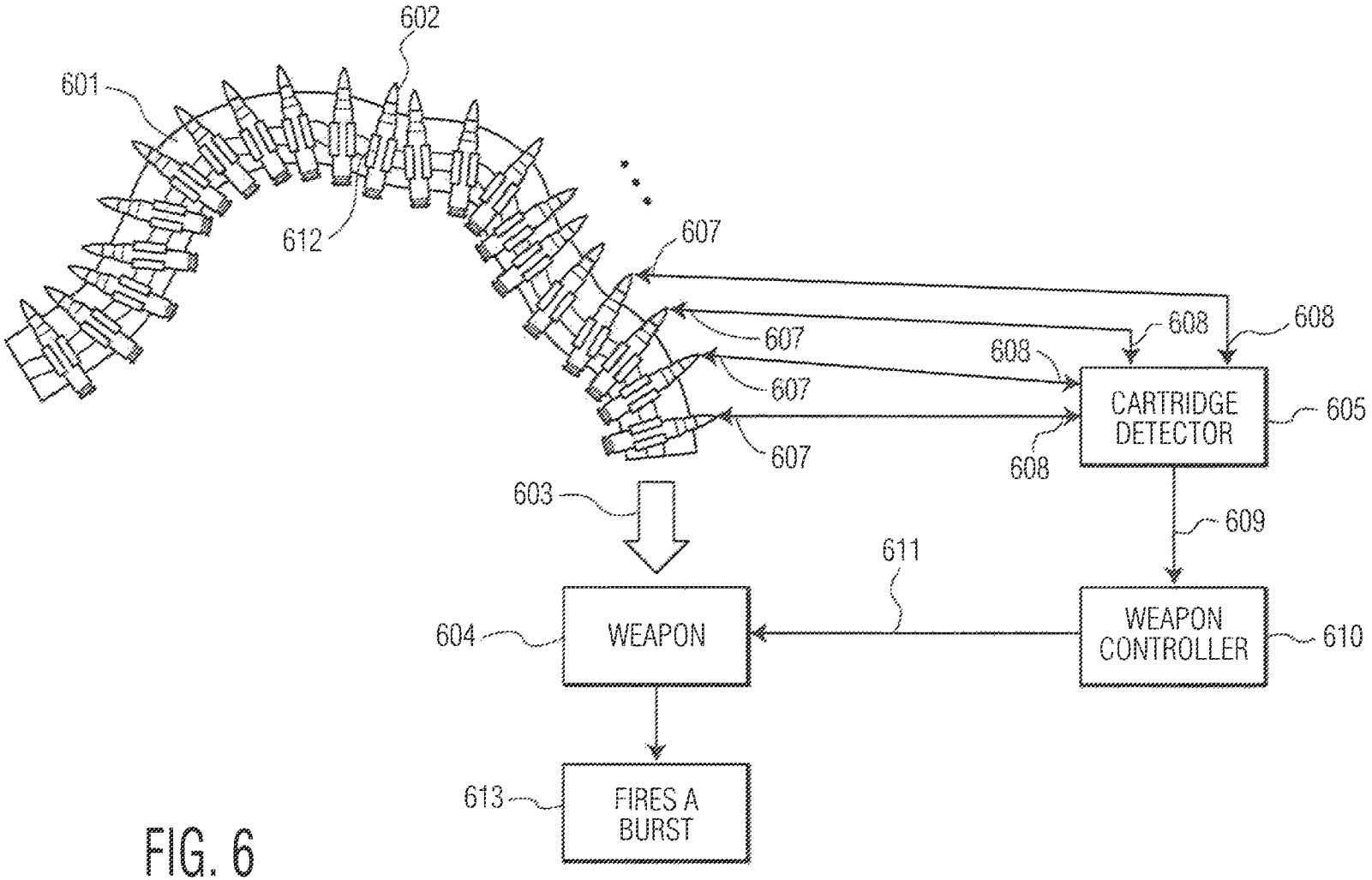

FIG. 6 shows ammunition cartridges 602 mounted on an ammunition belt 601 fed in into a weapon 604 which, under control of a weapon controller 610 discerns coolant cartridges, and also fires all the cartridges in a burst 613.

DETAILED DESCRIPTION

Figure 1:
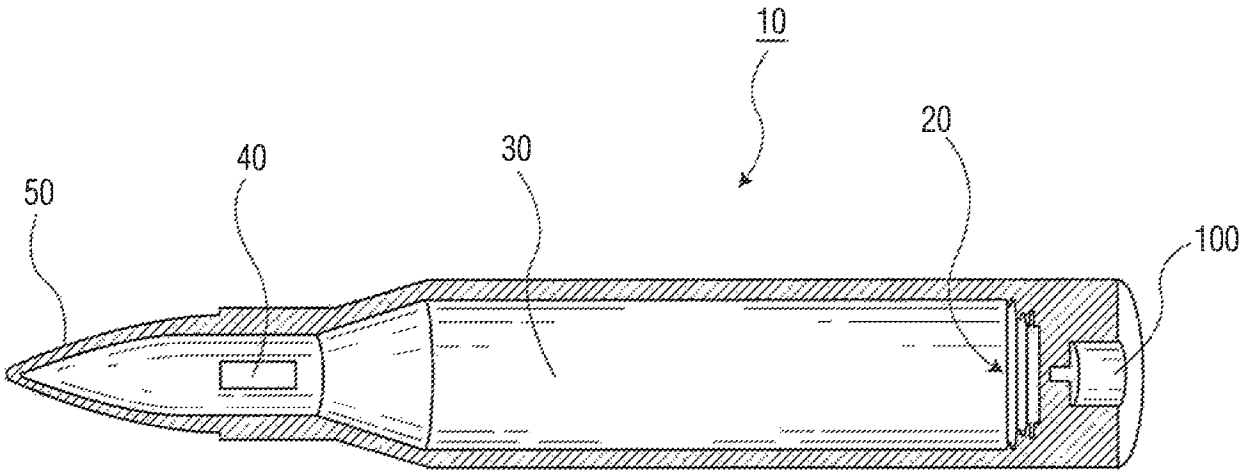
FIG. 1 shows a sectional plan view of a coolant cartridge 10, ready to be fired, in accordance with this invention.
Figure 2:
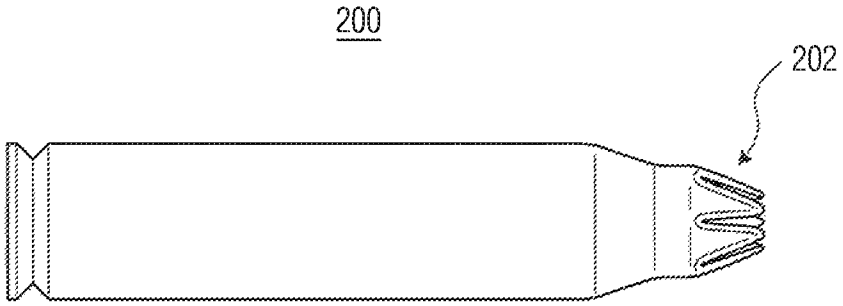
FIG. 2 shows another coolant cartridge wherein the nose area of the round is sealed by crimping, 202, to completely seal and contain all the fluids or powders without leakage, in accordance with this invention.
Figure 3:
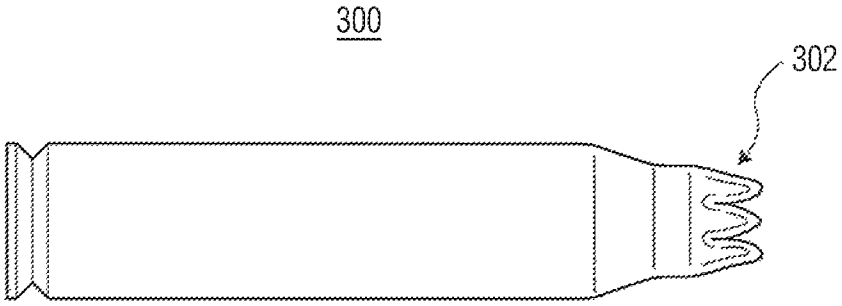
FIG. 3 illustrates a coolant cartridge after firing, with ruptured open crimps 302 at the frontal areas of round that allows the then already pressurized fluids or powders to flow into the bore of the barrel, in accordance with this invention.
Figure 4:
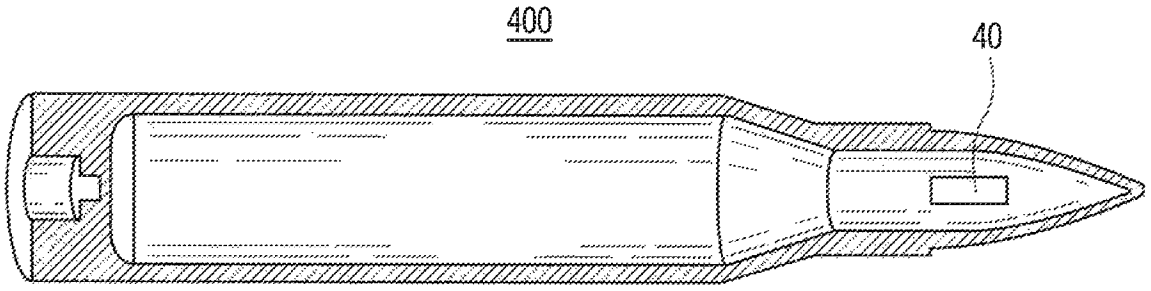
FIG. 4 illustrates a polymer type cartridge 400 which might be adapted to serve as a coolant cartridge, in accordance with this invention.
Figure 5:
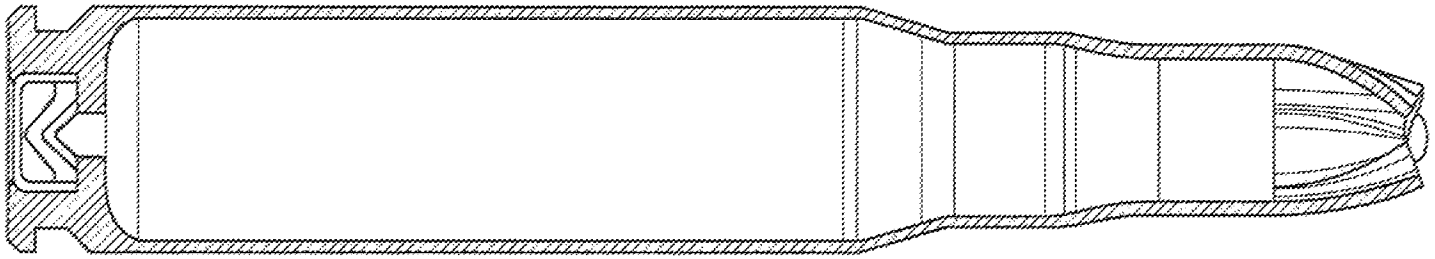
FIG. 5 illustrates a brass type cartridge 500 with frontal crimps which might be adapted to serve as a coolant cartridge, in accordance with this invention.

The invention is discussed with reference to all the FIGS. 1-6, as follows. FIG. 1 shows a sectional plan view of a cartridge 10 ready to be fired. The cartridge cavity is completely filled with 30, being powders or fluids, or liquefied magnetic fluids, combinations thereof, right from the tip of ogive 50 all the way back to a rear most partition 20. The fluids or powders may contain magnetic bits, or be magnetic, the presence of which may allow for their detection as by element 605 in FIG. 6 for example. Upon firing pin striking a primer 100, the hot, high pressure gases generated by the primer cause rear most partition 20 to rupture. This allows hot gases to pressurize the cavity containing the fluids or powders. The pressurized fluids or powders cause engineered weak points 40 in the ogive 50 to rupture. This then allows the fluids or powders to flow into the bore of the barrel. The engineered weak points may for example be small rectangular areas such as shown by 40, or of other shapes, which have shallow cuts into the surfaces of the ogive, or of other areas on the cartridge cavity. In another environment, instead of an ogive the frontal areas may be crimped as in FIG. 2. In FIG. 6, ammunition cartridges 602 are mounted on an ammunition belt 601 which may have accompanying ammunition links 612 thereon at location of each cartridge case. Ammunition belts may be made of pieces of canvas cloth material that have been joined together as by stitching. Current belts may use metal links to hold the ammunition canisters into a long belt; there would be one link per cartridge. The cartridge is pulled by the link then fed into the firing chamber. The belt may be fed in direction 603 into a weapon 604 which, under control of a weapon controller 610 then fires the cartridges in a burst 613. Contacts 607 which sense presence of each cartridge, feed electrical signals 608 indicating this detection information to cartridge detector unit 605. Detection of a cartridge may be by closing an electric circuit with one of the metallic links 612, or it may indicate presence of magnetic material in the cartridge (or that the entire cartridge case perhaps is magnetic) as for instance by influencing an electromagnetic field at a contact 607 as a cartridge case passes by. The magnetic presence would therefore indicate a coolant cartridge as distinguished from an ordinary cartridge. Cartridge detector 605 feeds its sensing information forward to weapon controller 610, which among information may indicate exact location, perhaps arrival of, a coolant cartridge or cartridges, as well as of ordinary cartridges. The weapon controller 610 may be designed to anticipate when liquid or powder filled cartridges are going to be chambered. The weapon controller 610, among other functions, can initiate, delay, halt or adjust the firing bursts accordingly. The weapon controller 610 may be designed, for instance, to extend firing bursts such that a conventional cartridge is always the first round fired at the beginning of each trigger pull sequence (or perhaps oppositely that the magnetic coolant cartridge will be the first to be fired when the trigger is pulled). FIG. 2 shows a variant 200 to the coolant cartridge. Instead of having a closed ogive 50 with engineered weak areas 40 as in FIG. 1, here in FIG. 2 the nose area of the round 200 is sealed by crimping, such as 202. When crimped, the round is completely sealed and contains all the fluids or powders without leakage. However, during firing, the crimps will open. As in FIG. 1, upon a firing pin striking a primer, the hot, high pressure gases generated by the primer cause a rear most partition to rupture. This allows hot gases to pressurize the cavity containing the fluids or powders. The pressurized fluids or powders cause crimps 202 to rupture or open. A ruptured example 300 of an already fired, crimped version FIG. 2 cartridge 200, is shown by FIG. 3 which shows ruptured open crimps 302 at the frontal areas of round 300. The rupturing then allows the then already pressurized fluids or powders to flow into the bore of the barrel. FIG. 4 illustrates a polymer type cartridge cavity 400 which might be adapted to serve as a coolant cartridge, while FIG. 5 illustrates a brass type cartridge cavity 500 with frontal crimps which might also be adapted to serve as a coolant cartridge.

Advantages inherent in this invention include an ability to eliminate the need to carry a spare barrel, to eliminate cook offs in externally powered weapons, to eliminate the need to make barrel changes during ongoing firing activity, to increase barrel life, and to reduce barrel weight. Each coolant cartridge contains enough coolant to offset the barrel heating from firing about eight conventional cartridges. The present invention provides a means for injecting extremely large amounts of coolant using a dedicated coolant cartridge. The carrier cartridge could have a crimped ogive, with the cartridge carrying a fully or nearly fully loaded interior of coolant. Conventional crimped blank cartridges can be produced in the millions of rounds per year, so manufacturing any required quantity of coolant cartridges may be done easily and inexpensively. Prototype coolant cartridges were fabricated for this invention using conventional brass cases. Firing was conducted of an extended burst, using a mixed belt of coolant and conventional cartridges, to successfully demonstrate the invention concept. Many proposed applications include on the Next Generation Squad Automatic Rifle (NGSAR), which requirements include advanced thermal management/thermal signature reduction, also on a 7.62 mm M 134 minigun, on an 7.62 mm EX-34, on a .50 caliber GAU-12 and GAU-19, on a 20 mm M61, on a 25 mm M242, on a 25 mm GAU-12, on a 30 mm GAU-8, on a 30 mm M230, and on a 30 mm Mk 44, and etc.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A coolant ammunition round for a firearm, comprising a sealed cartridge case (10) containing a primer (100) at an aft end thereof; and, an ogive (50) integral to the cartridge case;

a cavity in said cartridge case entirely filled with fluids or powders (30);

a sealed partition (20) between the primer and the said cavity; and, wherein upon a firing pin striking the primer (100), gases generated by the primer cause the sealed partition (20) to rupture, said gases pressurize the cavity containing the fluids or powders (30) causing engineered weak points (40) in the ogive (50) to rupture and vent the fluids or powders (30) into a bore of the firearm during firing, wherein said fluids or powders (30) comprise magnetic materials therein, and wherein the engineered weak points (40) are a series of rectangular shaped indented areas in the ogive.

2. The coolant ammunition round of claim 1 wherein the fluids or powders (30) comprise coolant, lubricant, preservative, antifreeze, cleaners, or mixtures thereof.

3. The coolant ammunition round of claim 2 wherein the fluids are liquefied magnetic materials or fluids which contain magnetic bits therein.

4. The coolant ammunition round of claim 3 wherein the powders are magnetic or contain magnetic bits therein.

* * * * *